United States Patent [19]

Birch et al.

[11] Patent Number: 4,475,696

[45] Date of Patent: Oct. 9, 1984

[54] TWO STATION WINDING APPARATUS

[75] Inventors: Steven W. Birch, Monroe; George E. Barnes, Pineville, both of N.C.

[73] Assignee: Birch Brothers Southern Incorporated, Waxhaw, N.C.

[21] Appl. No.: 427,453

[22] Filed: Sep. 29, 1982

[51] Int. Cl.[3] ..... B65H 17/08; B65H 25/04

[52] U.S. Cl. ..... 242/66; 242/57; 242/67.5

[58] Field of Search ..... 242/56 R, 57, 66, 67.5

[56] References Cited

U.S. PATENT DOCUMENTS

| | | | |
|---|---|---|---|
| 1,266,942 | 5/1918 | Henderson | 242/66 |
| 1,455,976 | 5/1923 | Stevens | 242/66 |
| 1,803,043 | 4/1931 | Valentine et al. | 242/66 |
| 2,441,439 | 5/1948 | Nelson | 242/66 |
| 3,972,486 | 8/1976 | Straujups | 242/66 |
| 4,000,863 | 1/1977 | Straujups | 242/56 R |
| 4,171,106 | 10/1979 | Crouse | 242/66 |

*Primary Examiner*—Stuart S. Levy
*Assistant Examiner*—Katherine Jaekel
*Attorney, Agent, or Firm*—Bell, Seltzer, Park & Gibson

[57] ABSTRACT

A roll of web material is initially supported at a first winding station and in engagement with spaced-apart first and second rolls which are driven at different peripheral speeds to provide a "tight" initial wind. The roll of web material is then transferred to a second winding station and supported in engagement with first and second winding rolls with the second winding roll being movable away from the first winding roll and further away from the first winding station as the size of the roll of web material increases so that large or jumbo size rolls may be wound on the apparatus.

10 Claims, 9 Drawing Figures

TWO STATION WINDING APPARATUS

FIELD OF THE INVENTION

This invention relates generally to an apparatus for winding web material into large or jumbo size rolls and more particularly to such an apparatus which includes a first winding station for winding the roll to a predetermined initial size and then transferring the roll to a second winding station for continuing the winding of the roll to a final large or jumbo size.

BACKGROUND OF THE INVENTION

There are many different types of winding apparatus disclosed in prior patents for winding various types of web material into successive rolls. U.S. Pat. Nos. 3,972,486 and 4,000,863 (owned by the assignee of the present invention) disclose a winding apparatus which supports a winding core at a first winding position for initial winding of the web material thereabout and then supports the roll of web material at a second winding position during continuation of winding to a final size.

The winding apparatus disclosed in these patents has achieved significant success in winding various types of web materials. However, the size of the final roll has been generally limited to a diameter of about fifty inches and this limitation is primarily imposed by the fixed lateral spacing between the first and second winding rolls at the second winding station. Also, the first winding station of the winding apparatus disclosed in said prior patents includes only a single winding roll for winding the web material to the predetermined initial size and it has been found that this arrangement may result in a "soft" initial size roll when winding certain web materials.

SUMMARY OF THE INVENTION

With the foregoing difficulties in mind, it is an object of the present invention to provide a winding apparatus in which the second winding station includes first and second winding rolls supported so that the lateral spacing therebetween can be increased as the diameter of the roll of web material increases so that large or jumbo size final rolls of up to one hundred inches may be wound on the winding apparatus.

The winding apparatus of the present invention is also provided with a first winding station which includes first and second winding rolls of considerably smaller size than the winding rolls at the second winding station and which are driven at different peripheral speeds so that a "tight" initial size roll of various types of web material may be formed at the first winding station. The considerably larger size first and second winding rolls of the second winding station are also rotated at different peripheral speeds so that the "tight" wind of the initial size roll is continued until the roll reaches the final desired size.

In the embodiment illustrated, the second winding roll of the second winding station is supported on the frame of the apparatus for lateral movement toward and away from the first winding roll by means of a screw or threaded shaft. Photoelectric detectors for roll size are provided to initiate operation of the threaded screw when the roll reaches a certain size so that the second winding roll is moved away from the first winding roll and to the proper position for continuing with the winding of the roll of web material.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
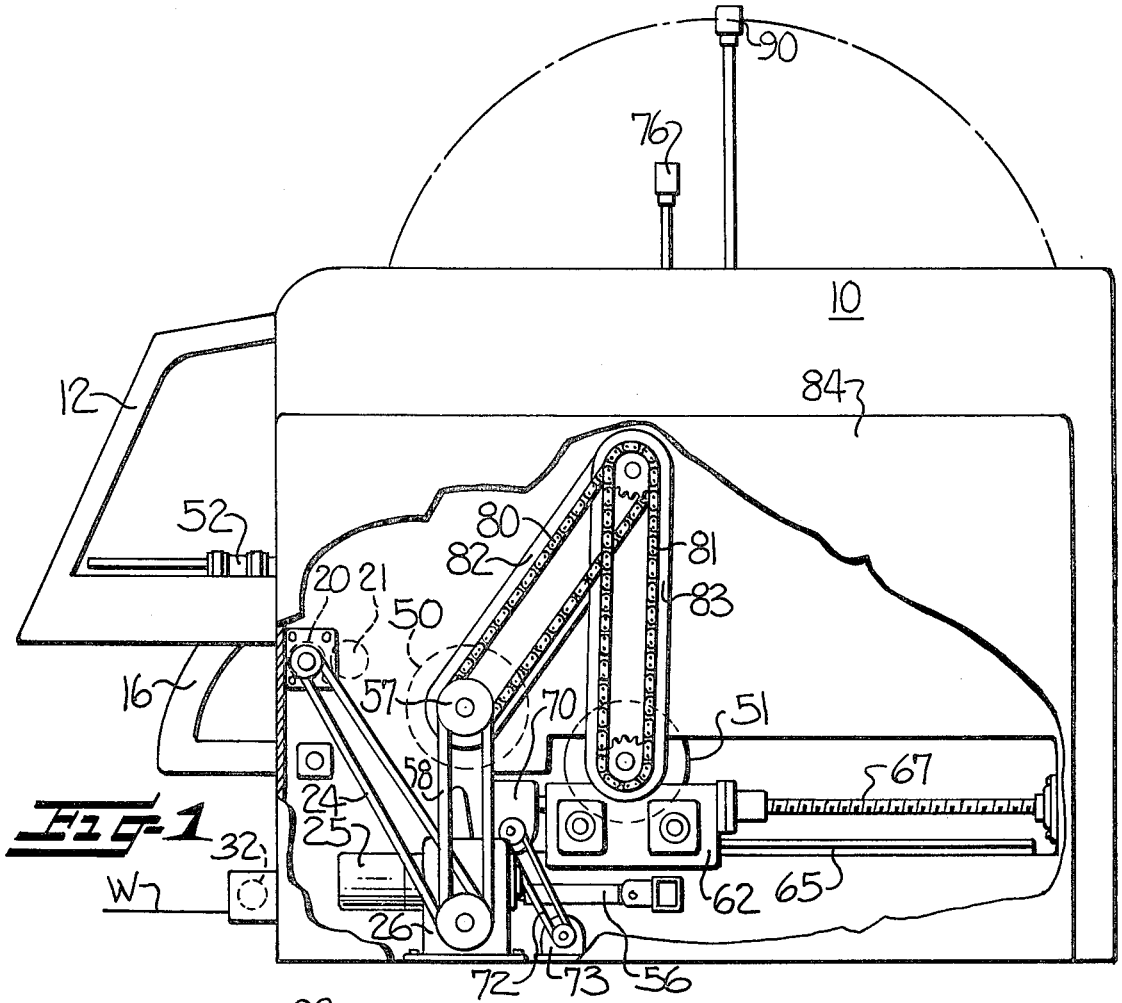
FIG. 1 is a side elevational view, with portions broken away, of one side of the present winding apparatus.

As illustrated in the drawings, the present winding apparatus includes side frames 10, 11, maintained in spaced-apart relationship by suitable cross frames and supporting a pair of trackways 12 forming a magazine for receiving and supplying a plurality of mandrels or winding cores 13 to a first winding station, broadly indicated at 15. Loading arms 16, 17 are pivotally supported intermediate their ends and adjacent the respective side frames 10, 11 and their lower ends are connected to hydraulic cylinders 18 which operate the upper free ends to pick up and move successive cores 13 to the first winding station 15 to begin the winding of each successive roll of web material. The operation of the loading arms 16, 17 is described in the aforementioned U.S. Pat. Nos. 3,972,486 and 4,000,863, incorporated herein by reference to the extent necessary for a full understanding of the invention.

Figure 2:
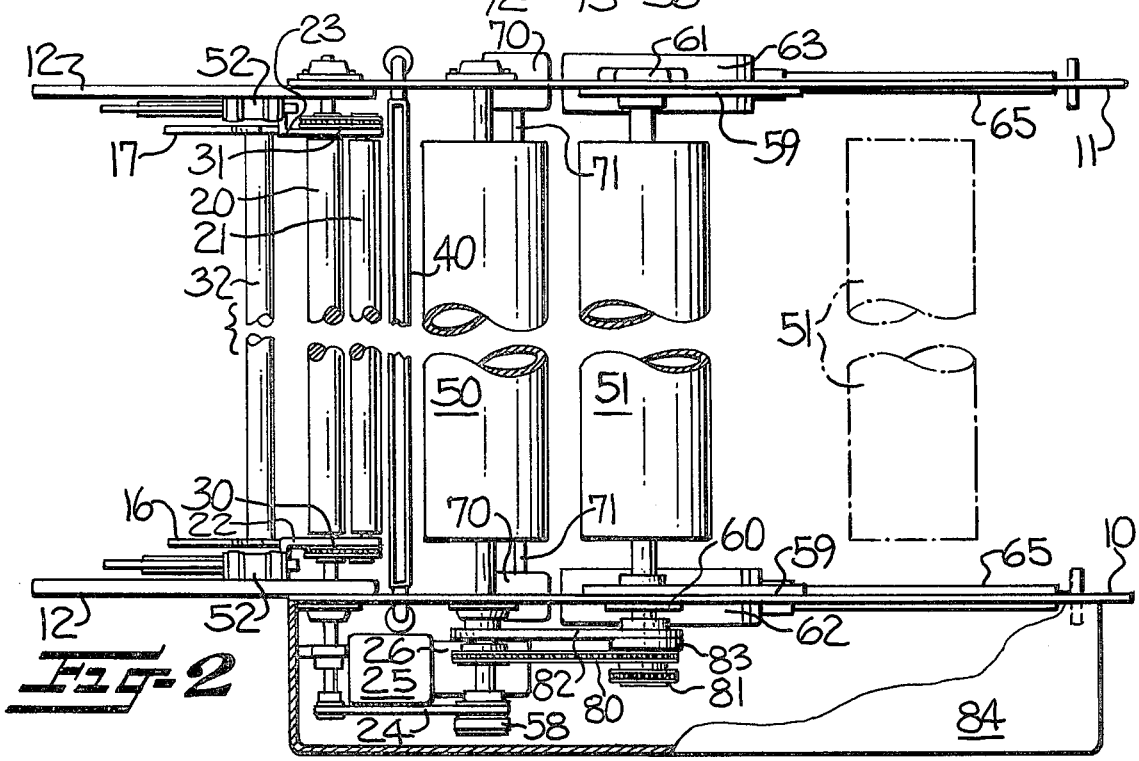
FIG. 2 is a plan view of the apparatus of FIG. 1 with portions broken away.

The first winding station 15 is illustrated as including respective first and second winding rolls 20, 21 rotatably supported on brackets 22, 23 (FIG. 2) fixed on the respective frame members 10, 11. The first drive roll 20 is rotated at a first relatively fast speed by a drive belt 24 (FIG. 1) which is in turn driven by a motor 25 and a variable speed drive unit 26. The second winding roll 21 is driven from the first winding roll 20 by sprockets and drive chains 30, 31 at opposite ends thereof (FIG. 2). The roll 21 is driven at a slightly slower peripheral speed than the roll 20 for purposes to be presently described.

Figure 3:
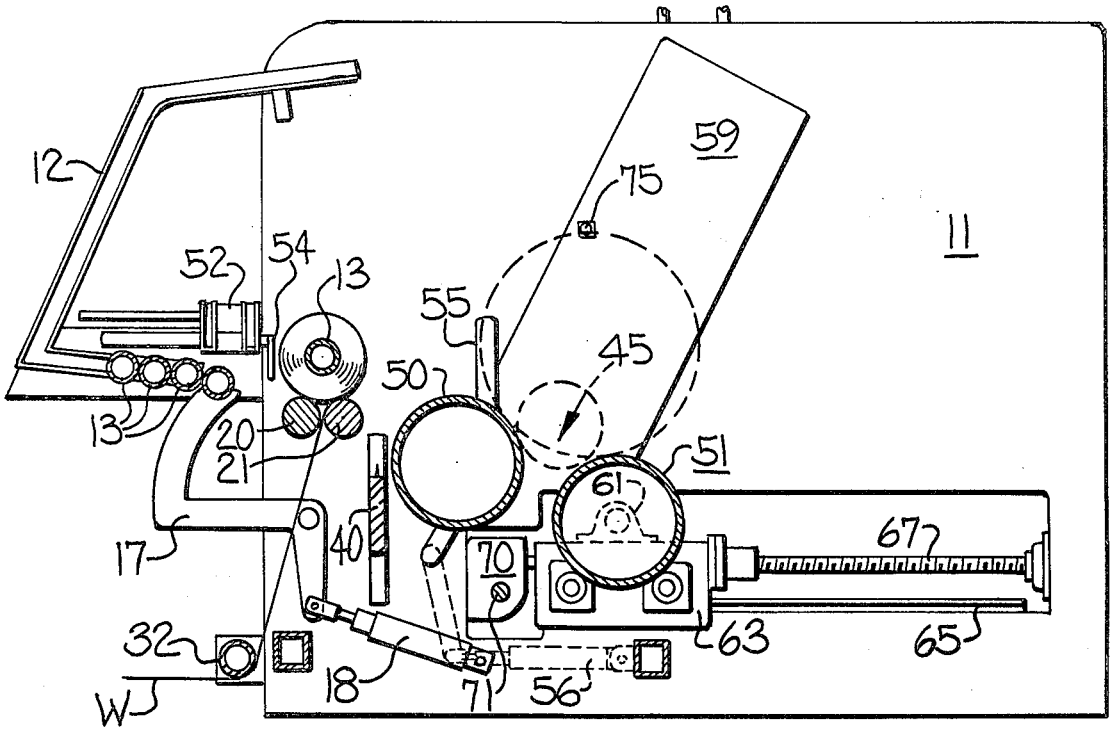
FIG. 3 is a vertical sectional view taken substantially along the line 3—3 in FIG. 2 and showing the roll of web material being initially wound at the first winding station and illustrating the roll of wound material in dotted lines at the second winding station.

The winding rolls 20, 21 at the first winding station 15 are rotated in the same clockwise direction and the web material, indicated at W, is guided into the winding apparatus beneath a guide roll 32 and between the winding rolls 20, 21 to be initially wound onto the mandrel or core 13, as illustrated in FIG. 3. Thus, the initial roll of material is rotated in a counterclockwise direction by the winding rolls 20, 21 and a "tight" roll is initially formed since the winding roll 20 is rotating at a faster peripheral speed than the drive roll 21 so that a slight stretching or tensioning of the web material occurs as it is wound onto the roll and between these winding rolls 20, 21.

When the roll of web material has reached the predetermined initial size, the roll of web material is transferred to the second winding station for completion of the winding to a large or jumbo size. The winding apparatus is provided with means for severing the web material and for directing the leading end of the web material about a winding core 13 positioned at the first winding position 15. The web severing means includes a moving chain cutter, indicated at 40, of the type disclosed in the aforesaid U.S. Pat. No. 4,000,863 and supported for vertical movement between the first winding station 15 and a second winding station, broadly indicated at 45.

The second winding station 45 is illustrated as including first and second winding rolls 50, 51 positioned in spaced-apart relationship and being rotatably supported on horizontal axes for supportingly receiving the initial size roll of web material from the first winding station 15. The first winding roll 50 is positioned between the second winding roll 51 and the first winding station 15 so that the second winding roll 51 is positioned further away from the first winding station 15 than the first winding roll 50. The first winding roll 50 is positioned with its upper peripheral surface at a higher level than the upper peripheral surface of the second winding roll 51. As shown in FIG. 3, the rolls 50, 51 are of the same diameter and the horizontal axis of the roll 50 is at substantially the same level as the upper peripheral surface of the roll 51. To initiate the transfer operation, transfer cylinders 52 are supported adjacent the inner portions of the opposite side frames 10, 11 and are provided at their inner ends with transfer plates 54.

When the cylinders 52 operate, the transfer plates 54 move forwardly and engage the ends of the core 13 to move the initial size roll over the roll 50 and into engagement with the upper end portions of the transfer arms 55. The arms 55 are pivotally supported in the side frames 10, 11 and their lower ends are connected to cylinders 56. As the initial size roll is moved over the roll 50, the arms 55 engage the ends of the core 13 and cushion the movement of the roll of web material into position between the rolls 50, 51, as shown by the smaller dotted circle in FIG. 3. When winding of the roll is completed, and the roll is doffed, the cylinders 56 return the arms 55 to the position shown in FIG. 3 so that they may receive the next initial size roll from the first winding station 15.

The shaft of the first drive roll 50 is suitably supported for rotation in the side frames 10, 11 and extends outwardly beyond the side frame 10 and is provided with a drive pulley 57 which is driven by a belt 58 from the variable speed drive unit 26. Thus, the first winding roll 50 is supported in a fixed position and is rotated at a predetermined peripheral speed by means of the variable drive unit 26. Suitable guide or spacer plates 59 are fixed on the inner portions of the side frames 10, 11 to center the ends of the core 13 as the wound material increases in size at the second winding station 45.

Means is provided for supporting the first and second winding rolls 50, 51 to provide relative movement between the horizontal axes of the first and second winding rolls 50, 51. The second winding roll 51 is illustrated as being rotatably supported on a horizontal axis for relative lateral movement toward and away from the horizontal axis of the first winding roll 50. To this end, the shaft of the second winding roll 51 is rotatably supported in bearing blocks 60, 61 (FIG. 9) which are in turn fixed on respective saddle supports 62, 63. The saddle supports 62, 63 are provided with spaced-apart guide rollers 64 which ride along rails 65, fixed on the corresponding side frames 10, 11 so that the second winding roll 51 can be laterally moved toward and away from the first winding roll 50, as illustrated in dotted lines in FIG. 8.

Figure 8:
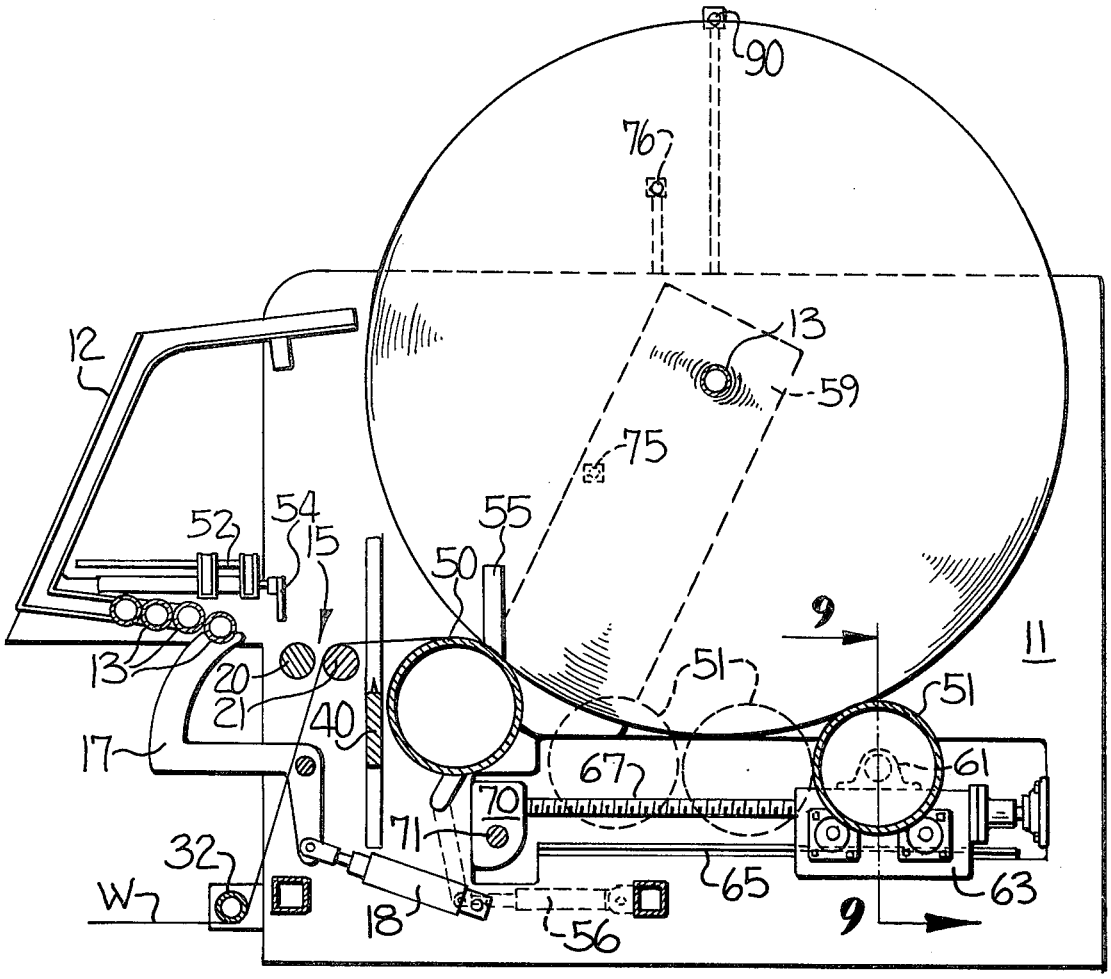
FIG. 8 is a view similar to FIG. 3 but illustrating the spacing of the winding rolls at the second winding station when the roll of wound material has reached the final size.
Figure 9:
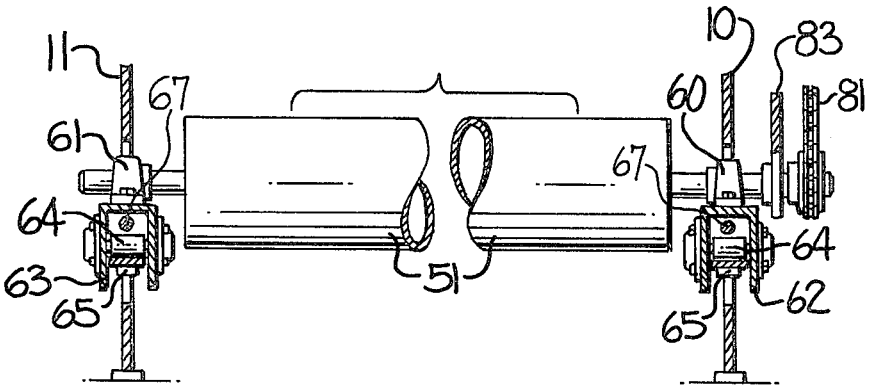
FIG. 9 is a vertical sectional view taken substantially along the line 9—9 in FIG. 8.

As illustrated in FIG. 3, the roll 51 is initially positioned relatively close to the roll 50 with the space between the rolls 50, 51 being less than the diameter of the roll 51. As shown in FIG. 8, the roll 50 is moved to a final spaced position where the spacing between the rolls 50, 51 is at least two times as large as the diameter of the roll 51.

Motive means is operatively associated with the second winding roll 51 for varying the lateral spacing between the first and second winding rolls 50, 51. The motive means is illustrated as including corresponding threaded shafts 67 rotatably supported at their forward ends on the respective side frames 10, 11 and passing through an internally threaded portion of the saddle supports 62, 63. The rear ends of the threaded shafts 67 are rotatably supported in corresponding worm and pinion drive units 70 fixed on the respective side frames 10, 11 and rotated by a connecting drive shaft 71. The connecting drive shaft 71 (FIG. 1) is rotated by a drive belt 72, drivingly connected to a reversible electric motor 73.

Operator means is operatively associated with the motive means for increasing the lateral spacing between the first and second winding rolls 50, 51 as the diameter of the roll of web material increases. The operator means includes roll size sensing means illustrated in the form of first and second photoelectric eye members 75, 76 which are supported on the inner portions of the corresponding side frames 10, 11. The operation of the photoelectric eye members 75, 76 will be presently described.

The second winding roll 51 is driven at a slightly higher peripheral speed than the first winding roll 50 so that a "tight" roll is continuously formed at the second winding station 45. The second winding roll 51 is driven from the first winding roll 50 by a "scissors" type drive arrangement including a pair of sprocket chains 80, 81 (FIG. 1) and pivotally interconnected first and second support plates 82, 83. The lower end of the first support plate 82 is supported on the drive shaft of the first winding roll 50 and the lower end of the second support plate 83 is supported on the drive shaft of the second winding roll 51. The drive sprockets for the chains 80, 81 are selected so that the second winding roll 51 is continuously rotated at a slightly faster peripheral speed than the first winding roll 50 as the second winding roll 51 moves from one position to another laterally spaced from the first winding roll 50. The drive belts and chains positioned on the outside of the side frame 10 are provided with a suitable cover, indicated at 84 in FIGS. 1 and 2.

After the initially wound roll has been transferred to the second winding station 45 by the transfer plates 54 and transfer arms 55, it continuously increases in size with the first and second winding rolls 50, 51 being laterally spaced apart as shown in FIG. 3. When the roll of web material reaches the size of the larger dotted circle in FIG. 3, the first photoelectric eyes 75 will signal that the proper size has been attained to impart a first step of lateral movement to the roll 51 away from the roll 50.

Figure 4:
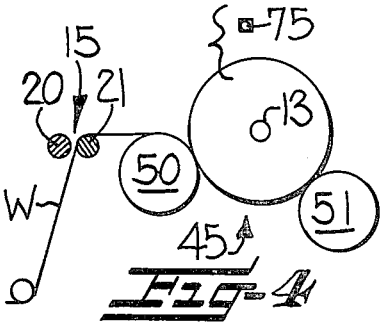
FIGS. 4 through 7 are schematic view generally similar to FIG. 3 and illustrating a sequence of operational conditions of the apparatus as the roll of web material is continuously wound to the final desired size.
Figure 5:
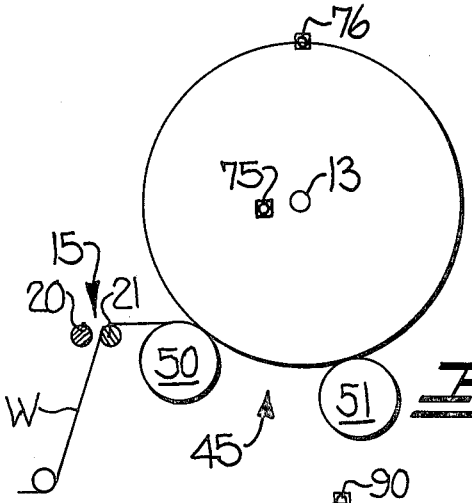
Figure 6:
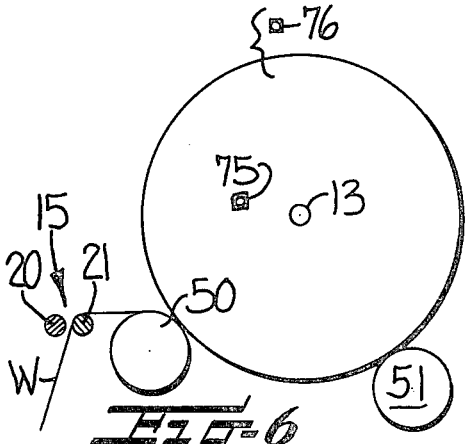

This lateral movement of the roll 51 is accomplished by activating the reversing motor 73 to impart rotation to the threaded shaft 67 and thereby move the saddle supports 62, 63 forwardly along the rails 65. Thus, the roll 51 will be moved from the position shown in FIG. 3 to the position shown in FIG. 4. The rolls 50, 51 will remain in the positions shown in FIGS. 4 and 5 with the wound material being supported on these two winding rolls 50, 51 until its diameter reaches the height where it will be detected by the second photoelectric eyes 76, as shown in FIG. 5. The motor 73 is then activated to move the roll 51 another step in movement away from the roll 50, to the position shown in FIGS. 6 and 7.

Figure 7:
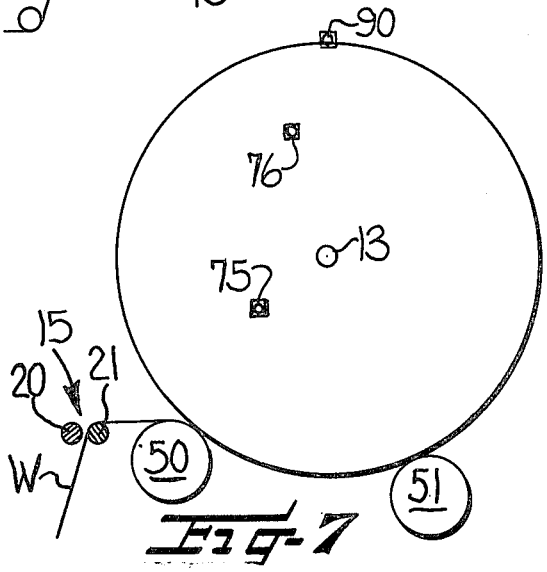

Then the roll of web material will continue to increase in diameter until it reaches the final desired diameter, as indicated in FIGS. 7 and 8, and the winding operation will then be completed when photoelectric eyes, indicated at 90, indicate the completion of the winding of the desired size of large or jumbo roll. At that time, the severing device 40 will be raised to cut the free end of the completely wound roll and the reversing motor 73 will be activated to rotate the threaded shaft 67 and move the saddle supports 62, 63 rearwardly along the rails 65 so that the roll 51 is again moved close to the roll 50, as illustrated in dotted lines in FIG. 8 and the roll will be doffed.

By rotating the first and second winding rolls 20, 21 at different peripheral speeds at the first winding station 15, it is possible to maintain a "tight" roll when initially winding the roll to the predetermined size. By rotating the first and second winding rolls 50, 51 at the second winding station 45 at different peripheral speeds it is also possible to continue the formation of a "tight" roll when the roll is continuously wound to its final diameter. Also, by providing lateral movement of the winding roll 51, relative to the winding roll 50 at the second winding station 45, it is possible to wind a much larger roll than has heretofore been possible (up to about 100 inches in diameter) and to also maintain the proper equilateral balance of the roll while it is being wound to the large size as it is cradled between the winding rolls 50, 51 at the second winding station 45.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. An apparatus for successively winding rolls of web material onto elongate cores, said apparatus comprising (a) a first winding station for winding a roll of web material on a core and to a predetermined initial size, said first winding station including (1) first and second winding rolls positioned in spaced-apart relationship and being rotatably supported for supporting the initial size roll of web material between said first and second winding rolls, (2) drive means for rotating said first and second rolls in the same direction and at different peripheral speeds to maintain a predetermined tension in the web material being wound on said initial size roll, and (b) a second winding station spaced from said first winding station and being adapted to receive the initial size roll of web material from said first winding station and to wind said roll to a predetermined final roll size, said second winding station including (1) first and second winding rolls of considerably larger size than said rolls of said first winding station and being positioned in spaced-apart relationship and being rotatably supported on horizontal axes for supportingly receiving the initial size roll of web material from said first winding station, said first winding roll being positioned with its upper peripheral surface at a higher level than the upper peripheral surface of said second winding roll, and said first winding roll being positioned between said second winding roll and said first winding station so that said second winding roll is positioned further away from said first winding station than said first winding roll, (2) drive means for rotating at least one of said winding rolls for continuing winding of the web material onto said roll until said roll increases in diameter to a predetermined final size, (3) means supporting said second winding roll for movement of said second winding roll toward said first winding roll along a substantially horizontal plane and to an initial position with the space between said first and second winding rolls being less than the diameter of said second winding roll, and for movement of said second winding roll away from said first winding roll along a substantially horizontal plane and to a final position with the space between said first and second winding rolls being at least two times the diameter of said second winding roll, and (4) means operatively associated with said second roll support means for moving said second winding roll from said initial position and away from said first winding roll to said final position along said substantially horizontal plane to thereby increase the spacing between said first and second rolls so as to accommodate the winding of the roll of web material to a predetermined final size.

2. An apparatus according to claim 1 including sensing means for detecting the size of the roll of web material being wound at said second winding station and for actuating said means operatively associated with said second roll support means when said roll of web material reaches a predetermined size.

3. An apparatus according to claim 1 wherein said first and second winding rolls of said second winding station are of substantially the same diameter.

4. An apparatus for successively winding rolls of web material onto elongate cores, said apparatus comprising (a) a first winding station for winding a roll of web material on a core and to a predetermined initial size, said first winding station including driven roll means for rotatably supporting the core and web material wound thereon, (b) a second winding station spaced from said first winding station and being adapted to receive the initial size roll of web material from said first winding station and to wind said roll to a predetermined final roll size, said second winding station including (1) first and second winding rolls positioned in spaced-apart relationship and being rotatably supported on horizontal axes for supportingly receiving the initial size roll of web material from said first winding station, said first winding roll being positioned between said second winding roll and said first winding station so that said second winding roll is positioned further away from said first winding station than said first winding roll, (2) drive means for rotating at least one of said winding rolls for continuing winding of the web material onto said roll until said roll increases in diameter to a predetermined final size, (3) means supporting said second winding roll for movement of said second winding roll toward and away from said first winding roll, and (4) means operatively associated with said second roll support means for moving said second winding roll further away from said first winding roll to thereby increase the spacing between said first and second rolls so as to accommodate the winding of the roll of web material to a predetermined final size, and (c) sensing means for detecting the size of the roll of web material being wound at said second winding station, said roll size sensing means being operatively associated with said second roll support means and being operable for detecting when the roll of web material reaches a predetermined size, said roll size sensing means including photoelectric eye means for detecting predetermined increases in diameter of the roll of web material being wound and for periodically activating said means operatively associated with said second roll support means to successively increase the lateral spacing between said first and second winding rolls when the roll of web material reaches predetermined increasing diameters.

5. An apparatus according to claim 4 wherein said first winding station includes first and second winding rolls positioned in spaced-apart relationship and being rotatably supported for supportingly rotating the initial size roll of web material between said first and second winding rolls, said first winding station also including driving means for rotating said first and second rolls in the same direction and at different peripheral speeds to maintain a predetermined tension in the web material being wound on said initial size roll.

6. An apparatus according to claim 4 wherein said means supporting said second winding roll at said second winding station comprises bearing means supporting opposite end portions of said second winding roll, a threaded shaft supporting each of said bearing means for longitudinal movement in one direction therealong with rotation of said threaded shafts in one direction and for longitudinal movement in the opposite direction with rotation of said threaded shafts in the opposite direction.

7. An apparatus according to claim 6 wherein said means supporting said second winding roll at said second winding station includes saddle supports threadably penetrated by said threaded shafts, rail members below said threaded shafts, and means supporting said saddle supports for longitudinal movement along said rail members.

8. An apparatus according to claim 7 wherein said means supporting said saddle members for longitudinal movement along said rail member comprises guide rollers supported on said saddle members and in rolling engagement with said rail members.

9. An apparatus according to claim 6 wherein said means operatively associated with said second roll support means includes a reversible electric motor, and drive means drivingly connecting said reversible electric motor to said threaded shafts for rotating said threaded shafts in either direction.

10. An apparatus according to claim 9 wherein said drive means includes a worm and pinion drive unit drivingly connected to one end of each of said threaded shafts, a drive shaft drivingly connecting said worm and pinion drive units, and means drivingly connecting said drive shaft and said reversible electric motor.

* * * * *